US006669064B2

(12) United States Patent
Perricone

(10) Patent No.: US 6,669,064 B2
(45) Date of Patent: Dec. 30, 2003

(54) BONDING NURSER

(76) Inventor: Nicholas V. Perricone, 27 Coginchaug Ct., Guilford, CT (US) 06437

( * ) Notice: Subject to any disclaimer, the term of this patent is extended or adjusted under 35 U.S.C. 154(b) by 51 days.

(21) Appl. No.: 10/077,557

(22) Filed: Feb. 14, 2002

(65) Prior Publication Data

US 2003/0150890 A1 Aug. 14, 2003

(51) Int. Cl.[7] ..... A45F 5/00

(52) U.S. Cl. ..... 224/148.6; 215/11.3; 215/11.6; 224/148.5; 224/603; 248/102; 248/104

(58) Field of Search ..... 224/148.6, 148.5, 224/602, 603, 148.1; 215/11.3, 11.4, 11.5, 11.6; 248/102, 103, 104; 606/234, 236

(56) References Cited

U.S. PATENT DOCUMENTS 4,657,151 A * 4/1987 Cabernoch ..... 215/11.6
4,776,546 A 10/1988 Goldson et al.
4,965,888 A 10/1990 Jones
5,086,517 A 2/1992 Jones
5,108,686 A 4/1992 Griffin
5,566,869 A * 10/1996 Katz ..... 224/148.6
5,582,335 A 12/1996 Beard et al.
5,690,679 A 11/1997 Prentiss
5,947,427 A * 9/1999 Holmquist ..... 248/102
5,979,843 A * 11/1999 Beck ..... 248/102
5,993,479 A 11/1999 Prentiss
6,241,135 B1 * 6/2001 Thatcher ..... 224/148.5

* cited by examiner

*Primary Examiner*—Gregory Vidovich
*Assistant Examiner*—Maerena W. Brevard
(74) *Attorney, Agent, or Firm*—St. Onge Steward Johnton & Reens LLC

(57) ABSTRACT

A bonding nurser that can be used to closely approximate breast feeding mechanically and psychologically comprises a feeding container that simulates a breast in fluid delivery, shape, texture, feel, and ease of infant suckling releasibly attached to a sling so that the container is positioned on the breast area of the adult feeding the baby, and the adult's hands are free for cuddling the baby during feeding. The feeding container is a breast-shaped flexible housing that holds a collapsible bag which delivers milk or other fluids through a nipple protruding through the apex of the housing and is filled through a screw cap opening at the base opposite the apex and secured in the housing by retaining straps surfaced with Velcro™. When the container is assembled, i.e., a bag is positioned in the housing, the straps present a loop interface that mechanically couples the base of the container to a correspondingly sized hook-surfaced area on a shoulder strap (or a hand strap).

11 Claims, 5 Drawing Sheets

BONDING NURSER

BACKGROUND OF THE INVENTION

1. Field of the Invention

The present invention relates to an infant feeding device that closely approximates natural breast feeding in the sensory experiences provided to the baby and promotes parent-baby bonding 1) mechanically, as the feeding container simulates a breast in its fluid delivery, shape, texture, feel, and ease of infant attachment for suckling, and 2) psychologically, as the nurser is designed to permit both the infant and the parent to assume a natural position where the infant can feel the body heat and heartbeat of the parent, the parent's hands are free to cuddle the infant during feeding, and the infant's face is pressed against the nipple to stimulate the perioral area and imitate a breast.

One of the largest shortcomings of conventional baby bottles and modern nursers with improved shapes is that the devices do not provide the full maternal benefits that are a necessary part of maximizing sustenance to the child, both physically and psychologically. Even recently engineered feeding containers that deliver more fluid with less air are typically advanced as baby bottle substitutes to be used by an adult holding the bottle in one hand which is offered to an infant cradled by the the adult's opposite arm and hand. Both the adult's hands are devoted to feeding and not cuddling the infant, the infant is not positioned next to the chest area of the adult, and the infant's face is not pushed against the nipple. Thus, important bonding opportunities that are inherent in the practice of breast feeding are not available with ordinary bottle feeding. This deprives infants cared for by their fathers or other men such as grandfathers, who now take an active role in child rearing in industrialized societies, or by non-nursing mothers, surrogate parents, and other infant caretakers, of the important positive bonding advantages obtained by infants who breast feed, and deprives the adults of significant bonding experiences with the infant. This invention addresses these concerns.

2. Description of Related Art

Myriad vessels with nipples, pap boats, and other nursing devices have been used for millenia for feeding infants as a substitute for breast feeding. In modern times, an elongated cylindrical bottle of glass or plastic, equipped with a cap and an enlongated latex nipple, became universally known and used as a conventional baby bottle. Only more recently have alternative feeding apparatuses been suggested as improvements over this basic design. These roughly fall into two groups: designs with a nipple that more closely approximate the shape of a human breast and designs that position the baby for feeding in a configuration more closely approximating that of an infant suckling from a breast.

In the former category, for example, Prentiss suggested an infant feeding container that was wider than a conventional baby bottle and had a nipple more closely approximating a breast-shape (U.S. Pat. No. 5,690,679; this and subsequent cited patents are expressly incorporated in their entireties by reference). This was said to more closely approximate the experience of natural breast feeding, and provide a bottle that was more stable for an older child to put down without tipping it over.

In U.S. Pat. No. 6,161,710, Dieringer and Suarez disclosed an improved natural nipple baby feeding apparatus which includes detachable inner and outer membranes which both extend substantially across a distance larger than the diameter of a standard baby bottle, providing a nipple surface more closely approximating a the areola of a human breast. The device was said to make it easier for a baby to "latch on" to in a manner similar to natural suckling of a breast, rather than sucking from an elongate smooth single rubber nipple of a conventional baby bottle, and hence, easier for the baby to alternate between breast feeding and bottle feeding. Prentiss suggested an infant feeding container in the overall shape of a breast, rather than just the nipple portion (U.S. Pat. No. 5,993,479). Holmquist provided a cushion under the nipple portion of a baby feeding apparatus and a spring-biased pressure plate to force a milk bag in the container portion toward the nipple as the milk level fell with the infant's feeding (U.S. Pat. No. 5,947,427). Griffin even more closely approximated a human nipple by suggesting nipple manufacture using a device formed from a mold taken of the nursing mother's breast so that the shape exactly replicated the mother's nipple (U.S. Pat. No. 5,108,686).

In the latter category of designs directed to positioning the infant, Jones disclosed a surrogate nursing bib that secured around the neck and around the waist of the wearer, and held a milk pouch that protruded from either of two orifices in the bib located on the chest of the wearer at the wearer's breast position (U.S. Pat. No. 5,086,517). Goldson and Goldson suggested a similar bib (U.S. Pat. No. 4,776,546). Beard and Beard suggested a nursing baby bottle holder that was a sling that could be draped around the neck of the person feeding the baby, which supported the baby bottle in a nursing position (U.S. Pat. No. 5,582,335).

It would be desirable to combine many of these desirable features with fluid delivery more closely approximating breast feeding to provide a baby nurser that more closely mimicks natural breast feeding and contributes to parent-infant bonding during feeding, and thus to the emotional stability of a healthy child.

BRIEF SUMMARY OF THE INVENTION

These objectives and others are provided by the present invention which describes an infant nurser that has a container that closely simulates the sensation provided by a mother's breast in its shape and fluid delivery and which is, in the preferred embodiment, attached to a shoulder sling and positioned over the breast of the person feeding the infant, leaving both arms free to caress the infant held in close proximity to the adult's chest. In an alternate embodiment, the same advanced design container may be attached to a hand strap so the infant can be fed as if the nurser were an ordinary baby bottle.

The two embodiments are illustrated in FIGS. 1 and 12, more fully described below. Briefly, the container has two main parts: a flexible, dome-shaped housing approximately in the form of a human female breast and having a centrally positioned aperture in the apex region of the housing and a securing means in the base rim region opposite the apex for holding a pouch in the interior of the housing and releasibly attaching the container to a hand strap or shoulder sling, and a pouch that contains fluids and conforms to the housing interior when placed inside it and comprises a collapsible bag having a nipple which protrudes through the housing aperture and allows passage of fluids therethrough when an infant suckles on the nipple, and an attachment collar and lid which holds a flanged end of the bag opposite the nipple through which fluids may be poured to fill the bag and hold fluids in it. Typical securing straps that hold the pouch in the dome housing have hook and loop fasteners such as Velcro™ so that the container can be easily emptied or filled by pulling apart the Velcro™ and putting in or taking out the pouch (illustrated in FIGS. 2 and 4). The bag of the pouch is preferably disposable plastic that doesn't need to be sterilized for repeated use, and the cap of the pouch has an attachment collar that holds and secures a flange on the bag and is threaded to receive a screw-on pouch lid (illustrated in FIGS. 5 to 7); the flange serves as a gasket, making the pouch leakproof when containing liquids and excluding air from the bag as the infant suckles.

The container is releasibly attached to either a hand strap or a shoulder sling. Preferred embodiments employing hook and loop fasteners, e.g., Velcro™, are illustrated in FIGS. 3 and 11. Both have container attachment sites that present a hook fastener area so that the container can be easily attached or removed from the sling or hand strap by simply placing the container on a Velcro™ patch on the sling or wrist strap and pulling it off. As mentioned above, in the preferred sling embodiment, the container attachment site is positioned over the breast of the person feeding the baby (FIG. 1). The hand strap embodiment positions the container attachment site in the palm area for convenience in feeding the infant by conventional means. In both cases, however, the suckling infant using a nurser of the invention has the benefit of of a feeding experience that simulates natural breast feeding in that the baby's face is pressed up against the container (as illustrated in FIG. 13) and the internal pouch slowly deflates while the baby is held up against the chest of the nurturing adult.

BRIEF DESCRIPTION OF THE FIGURES

To illustrate and explain the invention, the detailed description that follows make reference to the following annexed drawings.

DETAILED DESCRIPTION OF THE INVENTION

Figure 1:
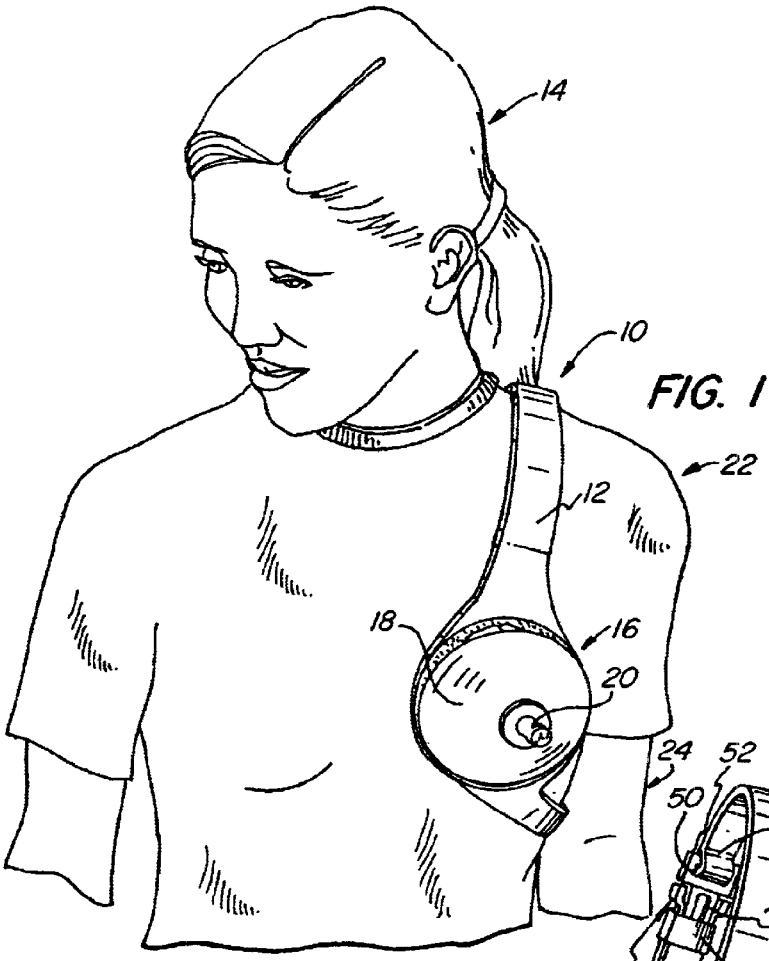
FIG. 1 is a front prospective view of a nurser of the invention in place on a person who will feed an infant, which comprises a breast-shaped container attached to a shoulder sling.

Various features of preferred embodiments of the invention are depicted in the figures. FIG. 1 is a front perspective view of a preferred embodiment of a nurser according to the invention, which is designated generally by the reference numeral 10, which depicts a shoulder sling nurser briefly described above. Nurser 10 includes a flexible shoulder sling 12 to which is attached, positioned in the breast area of user's chest 14 depicted in the Figure as a woman, container 16, which has the overall shape of a human breast in that housing 18 is dome-shaped with a nipple cap 20 protruding from the center of the apex region of the dome. Sling 12 fits over shoulder 22 of user 14 and under arm 24 as indicated, and is depicted as being slightly wider in shoulder region 22 and narrower under arm 24 for the comfort of user 14, but the relative widths are immaterial so long as the sling holds container 16 in the breast area of the user's. Typical slings used for nursers of the invention are fabricated from heavy duty fabric or belting materials; preferred slings are sufficiently soft to be comfortable for the user to wear year round and are machine-washable, e.g., cotton, cotton blends, and the like, typically reinforced with some polymeric fibers to provide durability.

Figure 2:
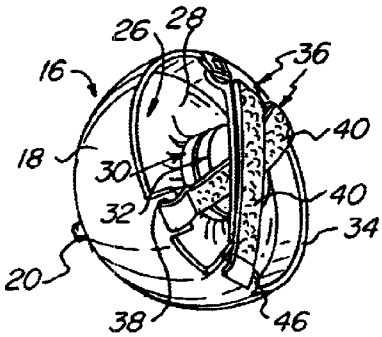
FIG. 2 shows a back prospective view of the container portion of the nurser depicted in FIG. 1 detached from the sling, exposing the interior of the container and illustrating that the container comprises a dome-shaped housing which holds a lidded pouch that conforms to the interior shape of the apex region of the housing, with folded securing straps on the base rim of the housing holding the pouch inside the housing, and that the straps have loop surfaces of a Velcro™ or similar attachment means.
Figure 3:
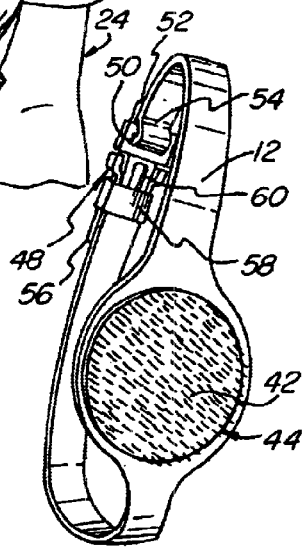
FIG. 3 shows a front prospective view of the sling portion of the nurser of FIG. 1 with the container portion detached, exposing a hook surface of a Velcro™ or other attachment means on the sling which conforms to the circular shape of the container so that the container illustrated in FIG. 2 may be attached by mechanical coupling to assemble the nurser for use as depicted in FIG. 1.

FIG. 2 illustrates container 16 removed from sling 12 and shows a back prospective view exposing the interior of housing 18, which holds pouch 26, and FIG. 3 shows a front perspective view of sling 12 with container 16 detached. Pouch 26 comprises bag 28, which extends from its bottom near nipple cap 20 to its top at attachment collar 30 and lid 32, to be more fully described below in descriptions of FIGS. 5 to 7. At circular base rim 34 of housing 18, four straps 36 are attached through four slots 38 that protrude from base rim 34 as tabs 46. Straps 36 are arranged on base rim 34 in pairs of two opposite one another along the circumference of the circle. Though the Figure shows two slots 38 closer together on either side of housing 18, they can be spaced further apart, as will become clearer in the description of FIG. 4 below. Surface 40 of straps 36 comprise loops in a loop pile of Velcro™ fabric to attach to hooks 42 in a hook pile of Velcro™ fabric attached to strap 12 as circular attachment surface 44. Circular attachment surface 44 has the same circumference as base rim 34 so that container 16 can be neatly attached to sling 12 when nurser 10 is in use, and can be secured to sling 12 using standard means such as glueing or sewing.

Since FIG. 3 shows sling 12 when not worn by user 14 fastener 48 on the back side of the sling is exposed. Fixed length slings may be employed in the practice of the invention, but adjustable slings are preferred so that sling size can be changed for the comfort of user 14 and adjusted to fit different-sized users using buckle assembly 48, but other buckle assemblies, ties, snaps, hooks and eyes, fabric latches, etc., alternative fasteners typically employed for belts and the like may also be employed (not shown). Buckle assembly 48 is comprised of slotted member 50 to which one end of sling 12 passes and is fixed to buckle member 50 in a stationary configuration by passing sling end 52 through a slot in 50 and joining end 52 to sling 12 at seam 54 by standard means such as sewing, riveting, or gluing. Buckle member 50 is sized to reversibly latch to buckle member 60 as a male-female joint. The other end 56 of sling 12 passes through cuff 58 as well as a slot on buckle member 60, so that end 56 can be pulled at the discretion of the user to shorten or lengthen the sling. Many variations of coupling connections of this type, including standard belts and belt buckles fabricated to releasibly attach easily, are known to the skilled worker, particularly for the manufacture of child care and sports equipment.

Figure 4:
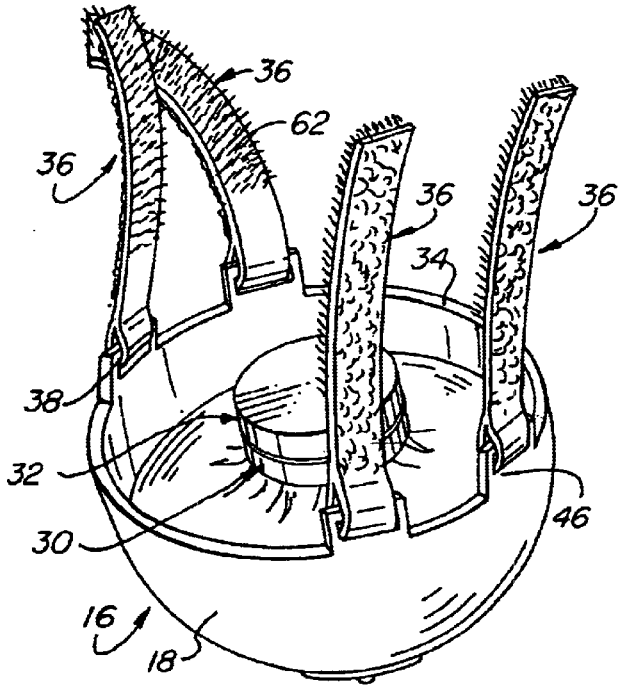
FIG. 4 is a back perspective view of the container of FIG. 2 illustrating the securing straps unfolded for removal of the pouch from the container housing and illustrating that the securing straps have hook surfaces of a Velcro™ or similar attachment means on the reverse side of the loop surface so that, when folded, the securing straps secure the pouch in the housing.

FIG. 4 is a back perspective view of container 16 with securing straps 36 unfolded to illustrate how container 16 is opened to remove pouch 26 from housing 18, exposing surface 62 on the other side of surface 40 of the strap. Surface 62 has hooks like those on surface 42. Use of Velcro™ fabric for securing straps 36 provides a very convenient hook and loop attachment means for the straps, since surface 40 on the straps can interact with both surface 62 or surface 42, providing attachment of the securing straps to each other to hold pouch 26 in housing 18 and to attach container 16 to strap 12 at surface 42 by mechanical coupling, providing nurser 10 of the invention. FIG. 4, like FIG. 2, shows straps 36 attached to housing 18 by passage through slots 38 in tabs 46 protruding from base rim 34, but any attachment means known to the skilled artisan such as hinges or rings that mount straps 36 to housing 18 accomplish the same purpose may be employed in alternate embodiments (not shown).

Figure 6:
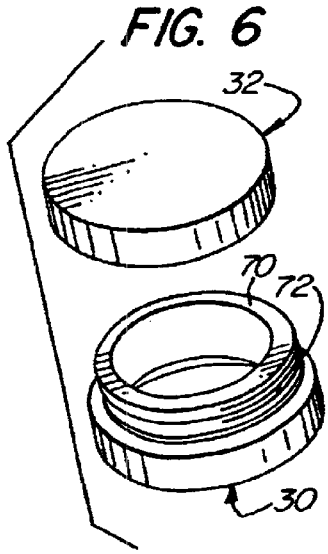
FIG. 6 is a side perspective view of an attachment collar and lid for the bag of the pouch.
Figure 5:
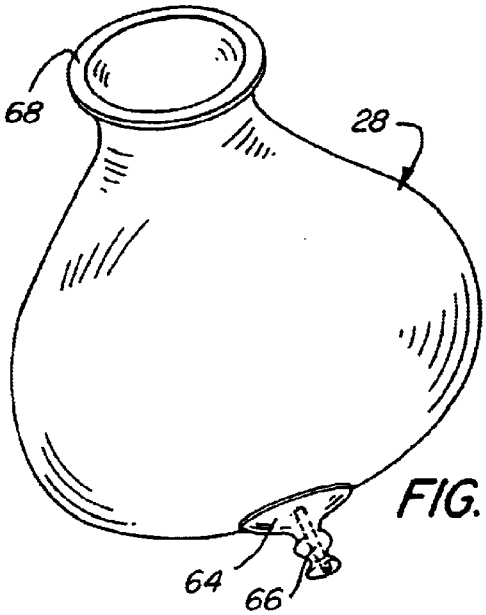
FIG. 5 is a side perspective view of a collapsible bag that holds fluid in the pouch and has a nipple on one end and a circular flanged opening on the other.
Figure 7:
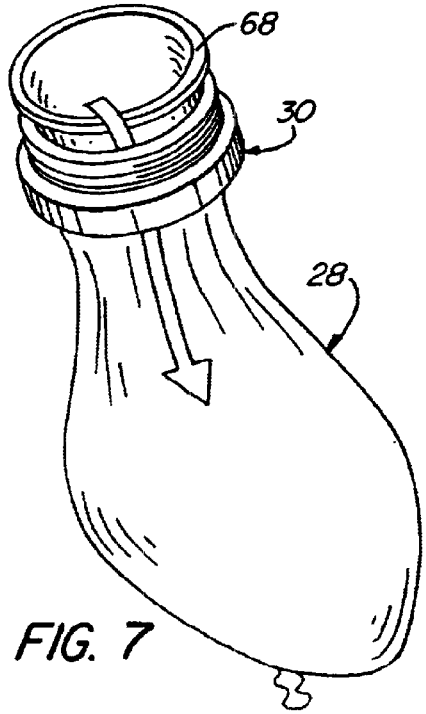
FIG. 7 is a side perspective view of how the bag is inserted through the collar, nipple end first, until the bag flange meets the collar.

FIG. 5 is a side perspective view of bag 28, which is collapsible and holds whatever fluid is going to be fed to the infant, such as milk, formula, juice, or water, in pouch 26. Preferred bags used in nursers of the invention are clear or translucent plastic and are disposable, but sterizable ones can also be used. Myriad polyethylene and the like materials are known to the skilled worker for the fabrication of bag 28. Bag 28 is sized to fit inside housing 18 when assembled into pouch 26 to be more fully discussed below in the explanation of FIG. 9. Nipple 64 is located at the bottom of bag 28, and has orifice 66 through which fluids flow when the infant suckles on the nurser. Circular flange 68 on the top of bag 28 is sized to be sufficiently large enough for pouring liquids into bag 28 and to fit snugly against surface 70 of collar when bag 28 is fitted through collar 30 as depicted in FIG. 7. The assembly of bag 28, 30 and 32 together form pouch 26, which holds fluids for the infant's consumption in container 16 without leakage. Therefore, lid 32 of FIG. 6 is sized to tightly fit collar 30. FIG. 6 shows collar 30 having threads 72 that interact with corresponding threads in cap 32 (not shown), providing a screw-on pouch top, but a simple cork assembly (not shown) will suffice. However, the illustrated embodiment is much preferred because the assembly of flange 68 of bag 28 against surface 70 of collar 30 with lid 32 screwed on enhances the seal because the flange acts like a gasket between lid 32 and collar 30. Thus, not only is fluid leakage minimized, but air entry into the bag as the infant feeds is also minimized, with consequent minimization of discomfort to the baby often observed with conventional baby bottles (to be more fully discussed below).

Figure 8:
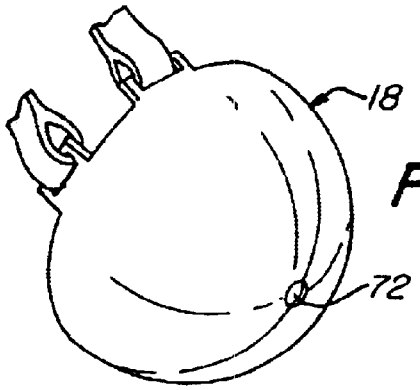
FIG. 8 is a front perspective view of the dome-shaped housing portion of the container which has an aperture in the apex region and securing straps attached in the base rim region.

FIG. 8 is a front perspective view of dome-shaped housing 18, which, without bag 28, has aperature 72 in the apex region of the dome through which nipple 64 protrudes. Housing 18 is fabricated from a durable, pliable, resilient material, preferably plastic, sufficiently strong to provide a durable container 16, but sufficiently soft and malleable to mimic a breast when a filled bag 28 is installed therein. As with bag 28, any plastic materials are available to the skilled artisan for the fabrication of housing 18, and preferred embodiments employ optimal plastics that function well together to achieve an optimal container 16. Preferred plastics for use in all container components of the invention are sterilizable, preferably autoclavable, for home or hospital use. Housing 18 may even be flesh-colored and slightly textured like skin. It is an advantage of the invention that the nurser so closely resembles a breast that nipple confusion often observed when infants switch from a breast to a bottle, which interrupts feeding and can cause infants considerable distress, is minimized or eliminated.

Figure 9:
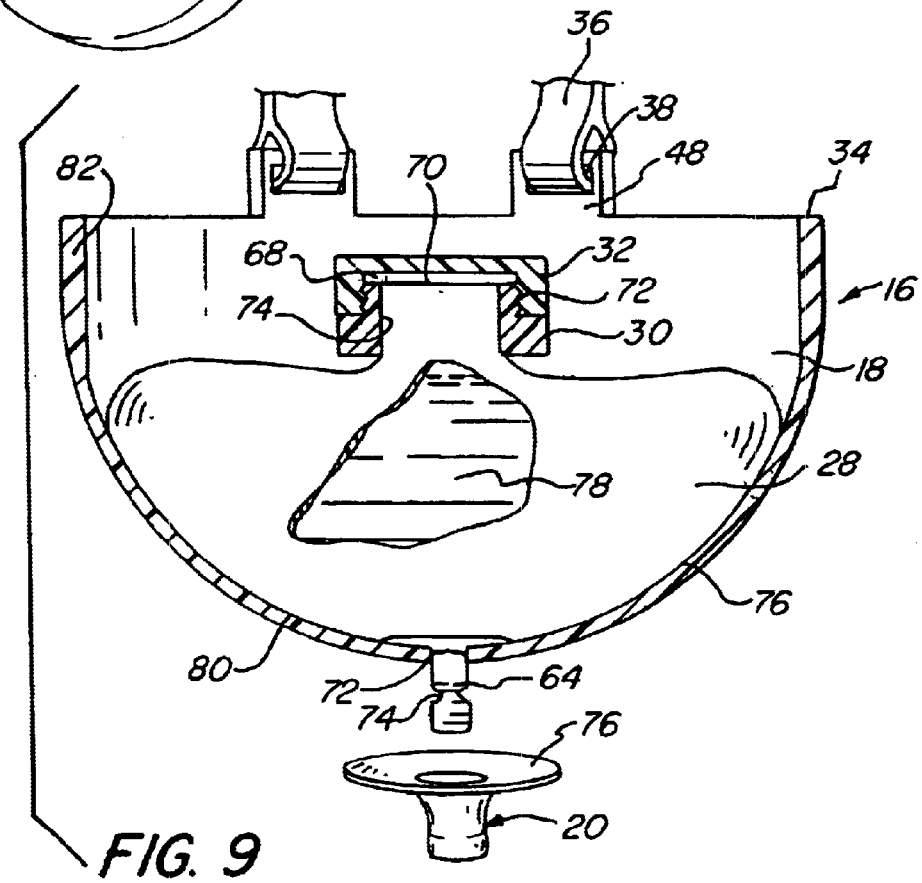
FIG. 9 is a cross-sectional view of the container showing the strap attachment to the container and illustrating the pouch comprising the filled fluid bag with its collar in place in the container, and with the bag nipple protruding through the housing aperture, and further comprising a nipple cap.
Figure 13:
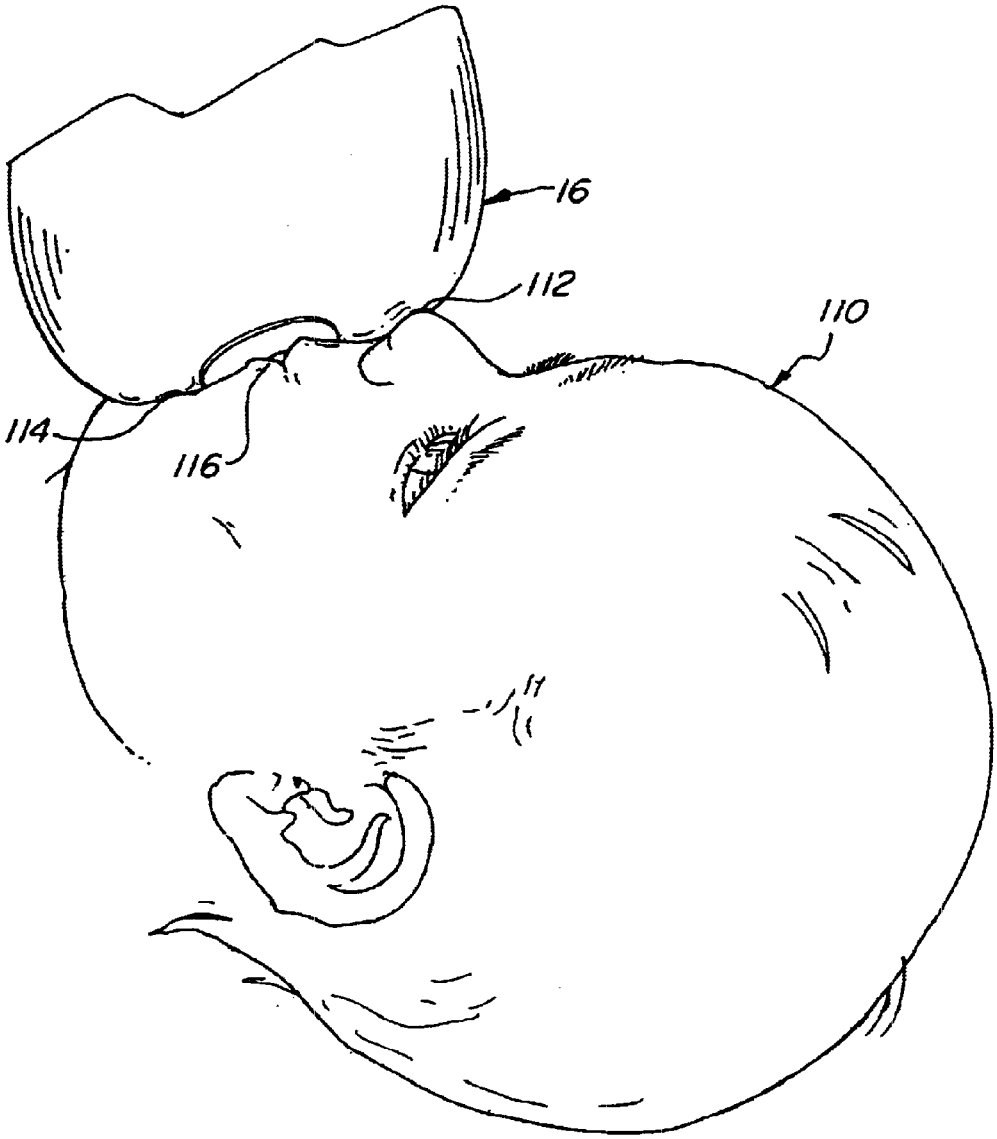
FIG. 13 is a side perspective view of an infant suckling from a nurser of the invention, illustrating how the entire area of the infant's face around the mouth, including the nose, presses up against the nipple area of the nurser in use as an infant's does in breast feeding.

FIG. 9 is a side cross-sectional view of container 16 of the invention. Strap 36 is joined to housing 18 by passage through slots 38 in tab portion 48 as previously described. The Figure illustrates cap 32 threaded at 72 onto collar 30 as previously described, with flange 68 flaring out from neck region 74 of bag 28 and to fit against surface 70 of cap 30 and held down by cap 32 so that fluids do not leak. Nipple 64 passes through aperture 72, and has a circumferential indentation 74 that is sized to clip on to circumferential protrusion 84 of FIG. 10 in nipple cap 20 when the nurser is not in use (to be discussed below). The nipple design advantageously provides an excellent attachment site for the infant's mouth to easily grip and suckle. FIG. 9 also shows another important structural feature of the invention, namely that bag 28 fits against and ajoins interior surface 76 of the apex region of dome-shaped housing 18 when bag 28 contains fluid 78. The design of collapsible bag 28 against pliable housing 18 held in place by straps 36 provides a unique container for nursers of the invention because both the bag and the housing act in concert to mimic the malleability and texture of a breast and collapse slightly against the face of the infant in the mouth and nose area as depicted in FIG. 13 (to be more fully discussed below). As shown in FIG. 9, in preferred embodiments, housing 18 is thinner in apex area 80 and thicker in area 82 near and at base rim 34. Thicker base region 82 in housing 18 provides structural integrity to container 16, and thinner apex region 76 provides the supple pliancy of the container area around the nipple. Moreover, the design allows for bag 28 to slowly deflate as fluid 78 drops in container 16. Since lid 32 is screwed down on collar 32 when pouch 26 is prepared, with flange 68 on bag 28 acting like a gasket, fluid 78 is sucked out of container 16 with very little air delivery to the infant as it suckles, feeding is more comfortable for the baby and gas delivery to the intestinal tract is minimized, avoiding stomach cramps and frequent and/or excessive belching after feeding.

Figure 10:
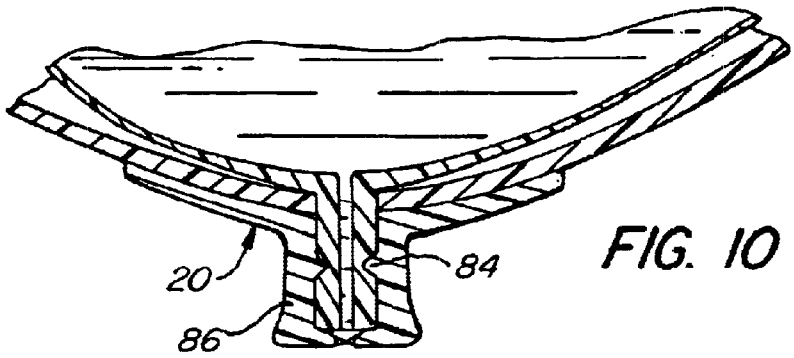
FIG. 10 is an exploded side cross-sectional view of the container nipple area of FIG. 9 with the a nipple cap installed over the nipple.

FIG. 10 is an exploded side cross-sectional view of the nipple area of FIG. 9 with the nipple cap 20 installed to cover nipple 64. When nipple cap 20 covers nipple 64, circumferential flange 84 in stem area 86 of nipple cover 20 clicks into place in circumferential indentation 74 in the stem area of nipple 64 (shown in FIG. 9). Circumferential indentation 74 in nipple 64 is sized to fit circumferential flange 84 of nipple cap 20 to protect nipple 64 when container 16 is not in use. FIGS. 9 and 10 together also show that flange 76 of nipple cap 20 fits snugly fit against housing 18 in the area around aperture 72 to protect the nipple and provide a detachable cap that is easy for the user to remove or replace and large enough to be readily found if misplaced by the user.

Figure 11:
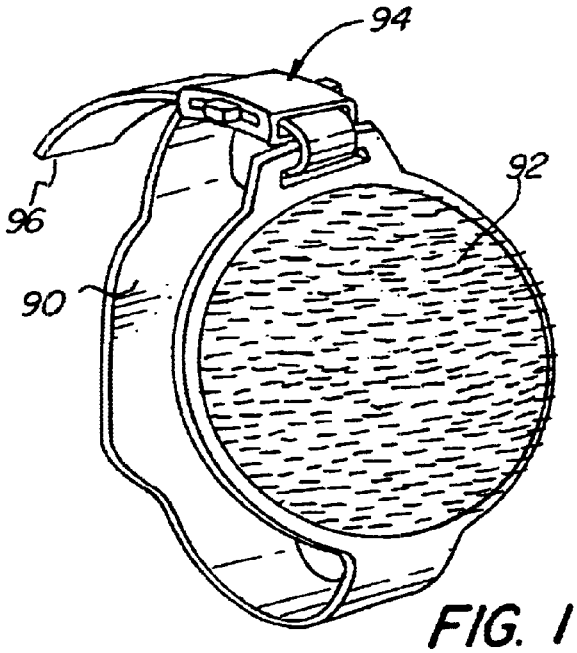
FIG. 11 is a front perspective view of an alternative embodiment comprising a container attached to a hand strap instead of the sling of FIG. 2 and showing the same type of hook surface of a Velcro™ or other attachment means for attaching the container.
Figure 12:
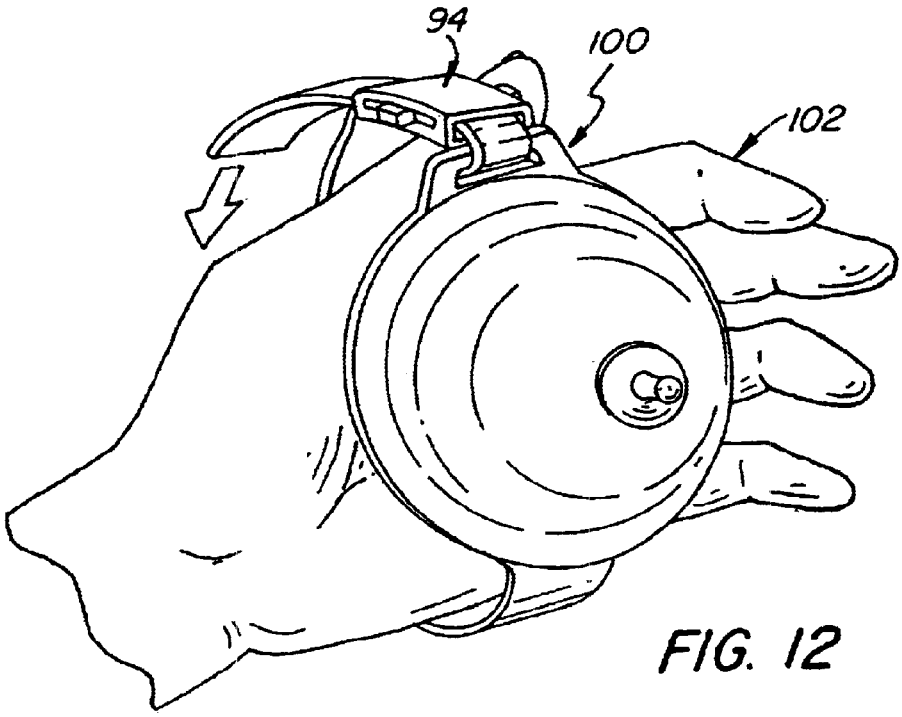
FIG. 12 is a front perspective view of the hand strap embodiment of the invention with the container attached, illustrating its placement in the palm of the hand of a person who will feed an infant.

FIGS. 11 and 12 illustrate an alternate nurser embodiment to the sling depicted in FIG. 1, but using the same container. FIG. 11 is a front perspective view of hand strap 90 presenting circular attachment surface 92 which is analogous to, and the same size as, circular attachment surface 42 on sling 12. Surface 92 has hooks that engage with the loops on surface 40 of securing straps 36 on container 16 to attach container 16 to the handstrap to provide nurser 100 depicted in FIG. 12. Hand strap 90 has an adjustable buckle assembly 94 corresponding to buckle assembly 48 of sling 12 shown in FIG. 3.

As shown in FIG. 12, which is a front perspective view of the handstrap embodiment, illustrating placement of a nurser of the invention in the palm region of user hand 102. As shown by the arrow, strap end 96 is simply pulled through buckle 94 to fasten nurser 100 to the hand, so that infant 110 of FIG. 13 can be fed as with a conventional baby bottle. An advantage of the invention is that, since both the shoulder sling and the hand strap are designed to attach to the same container, either nurser 19 or nurser 100 can be conveniently provided in a kit with sling 12, hand strap 90, housing 18, collar 30 and lid 32, and nursers can be assembled for either breast-type or lap-type feeding at the option of the person feeding the infant by adding disposable bags 28.

FIG. 13 is a perspective view of infant 110 suckling from container 16. The drawing illustrates another important feature of the invention mentioned above, namely that the face of infant 110 in nose area 112, chin area 114 and adjacent areas around lips 116 are pressed up against container 16 as the baby feeds from the nurser. This is what happens in natural breast feeding. When combined with the design of container 16 as described above, nursers of the invention more closely mimic natural breast feeding than previously described nursers by stimulating the sensory perceptive nerves of the infant in the perioral region of the face. The sling embodiment of FIG. 1 allows the free hands of the adult feeding adult to caress the baby and hold it close to the warmth, smell, and heartbeat of the adult. Taken together, the nurser of the invention provides an optimal bonding experience during feeding for fathers, non-nursing mothers, and other infant caretakers.

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention, which is defined by the following claims.

What is claimed is:

1. An infant nurser that provides a feeding experience closely resembling natural breast feeding comprising a container which has a flexible, dome-shaped housing approximately in the form of a human female breast and having a centrally positioned aperture in the apex region of the housing and a releasable securing means in the base region opposite the apex for holding a pouch in the interior of the housing and said securing means further releasably attaching the container to a hand strap or shoulder sling, and a pouch that contains fluids and conforms to the housing interior when placed inside it and comprises a collapsible bag having a nipple which protrudes through the housing aperture and allows passage of fluids there-through when an infant suckles on the nipple, an attachment collar and lid which holds a flanged end of the bag opposite the nipple through which fluids may be poured to fill the bag and hold fluids in it, and a nipple cap.

2. A nurser according to claim 1 which comprises a container attached to a shoulder sling that fits over a shoulder and under an arm of a person feeding the infant, and has a container attachment site on the sling which is positioned such that the container attaches in the breast area of a person using the nurser to feed an infant.

3. A nurser according to claim 1 which comprises a container attached to a hand strap which has a container attachment site positioned to fit into the palm of a person feeding the infant.

4. A nurser according to claim 1 wherein the securing means for holding the pouch in the container housing comprise securing straps attached to the base rim of the container housing which can be mechanically coupled to secure the pouch in the housing.

5. A nurser according to claim 4 wherein the securing straps have hook and loop fasteners on their inner and outer surfaces which, after being mechanically coupled to secure the pouch in the housing, present loop surfaces for releasable attachment to a shoulder sling or wrist strap which have a corresponding hook surface.

6. A nurser according to claim 1 wherein the attachment collar of the pouch is threaded so that it can receive a screw-on pouch lid.

7. A nurser according to claim 1 wherein the bag is disposable plastic.

8. An infant nurser that provides a feeding experience closely resembling natural breast feeding comprising a container which has a flexible, dome-shaped housing approximately in the form of a human female breast and having a centrally positioned aperture in the apex region of the housing and straps in the base region opposite the apex, said straps having an inner hook surface and an outer loop surface which can be fastened and unfastened to hold a fluid-containing pouch in the interior of the housing, so that that the pouch can be placed inside or removed from the housing, wherein said pouch comprises a collapsible bag having a nipple which protrudes through the housing aperture and allows passage of fluids therethrough when an infant suckles on the nipple, a threaded attachment collar and screw-on lid which holds a flanged end of the bag opposite the nipple through which fluids may be poured to fill the bag in the pouch and hold fluids in it, and a nipple cap; and a shoulder sling that fits over a shoulder and under an arm of a person feeding the infant, and has a container attachment site positioned on the breast area of the person when worn which presents a hook surface for releasable attachment of the container's base with the loop surface of the straps securing the pouch, so that the nurser provides the infant with a nipple in approximately the position of a breast nipple and the person feeding the infant has both arms free to hold and caress the infant.

9. A nurser according to claim 8 wherein the bag is disposable plastic.

10. An infant nurser that provides a feeding experience closely resembling natural breast feeding comprising a container which has a flexible, dome-shaped housing approximately in the form of a human female breast and having a centrally positioned aperture in the apex region of the housing and straps in the base region opposite the apex, said straps having an inner hook surface and an outer loop surface which can be fastened and unfastened to hold a fluid-containing pouch in the interior of the housing, so that the pouch can be placed inside or removed from the housing, wherein said pouch comprises a collapsible bag having a nipple which protrudes through the housing aperture and allows passage of fluids therethrough when an infant suckles on the nipple, a threaded attachment collar and screw-on lid which holds a flanged end of the bag opposite the nipple through which fluids may be poured to fill the bag in the pouch and hold fluids in it, and a nipple cap; and a hand strap that fits over four fingers of the hand of a person feeding the infant, and has a container attachment site positioned on the palm area of the strap, which presents a hook surface for releasable attachment of the container's base with the loop surface of the straps securing the pouch.

11. A nurser according to claim 10 wherein the bag is disposable plastic.

* * * * *